US011386739B2

(12) United States Patent
Zhang et al.

(10) Patent No.: US 11,386,739 B2
(45) Date of Patent: Jul. 12, 2022

(54) VENDING MACHINE AND GOODS DELIVERY METHOD

(71) Applicant: Shandong New Beiyang Information Technology Co., Ltd., Shandong (CN)

(72) Inventors: Chunguang Zhang, Shandong (CN); Chong Zhou, Shandong (CN); Xinping Wang, Shandong (CN); Yuanbin Peng, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 276 days.

(21) Appl. No.: 16/954,970

(22) PCT Filed: Sep. 20, 2018

(86) PCT No.: PCT/CN2018/106665

§ 371 (c)(1),
(2) Date: Jun. 17, 2020

(87) PCT Pub. No.: WO2019/128331

PCT Pub. Date: Jul. 4, 2019

(65) Prior Publication Data

US 2021/0366223 A1 Nov. 25, 2021

(30) Foreign Application Priority Data

Dec. 29, 2017 (CN) ..... 201711470549.7

(51) Int. Cl.
*G07F 11/16* (2006.01)
*G07F 9/02* (2006.01)
(Continued)

(52) U.S. Cl.
CPC ..... *G07F 11/1653* (2020.05); *G07F 9/026* (2013.01); *G07F 11/007* (2013.01);
(Continued)

(58) Field of Classification Search
CPC ..... G07F 11/007; G07F 11/10; G07F 11/005; G07F 11/165; G07F 11/42
See application file for complete search history.

(56) References Cited

U.S. PATENT DOCUMENTS 6,499,627 B2 * 12/2002 Arai ..... G07F 11/62 221/253

FOREIGN PATENT DOCUMENTS

CN 202167081 U 3/2012
CN 103098103 A 5/2013
(Continued)

OTHER PUBLICATIONS

Chinese Office Action and Search Report dated Dec. 26, 2019, in application No. CN 201711470549.7. 20 pages.
(Continued)

*Primary Examiner* — Christle I Marshall
(74) *Attorney, Agent, or Firm* — Wilmer Cutler Pickering Hale and Dorr LLP

(57) ABSTRACT

Disclosed is a vending machine, including a cabinet, a bucket, a bucket drive mechanism, a first shutter mechanism, a second shutter mechanism, a controller and a storage column; a pickup port is arranged at the surface of the cabinet; the storage column stores the commodities; the bucket includes an inlet and an outlet; the inlet receives the commodity to be conveyed from the storage column, and the outlet is butted with the pickup port; the bucket drive mechanism drives the bucket to move in the cabinet; the first shutter mechanism blocks or opens the inlet; the second shutter mechanism blocks or opens the outlet; the controller controls the first shutter mechanism to open the inlet and the second shutter mechanism to block the outlet in the process of commodity to be conveyed entering the bucket. Further disclosed is a commodity conveying method.

20 Claims, 7 Drawing Sheets

(51) Int. Cl.
*G07F 11/10* (2006.01)
*G07F 11/00* (2006.01)

(52) U.S. Cl.
CPC ..... *G07F 11/10* (2013.01); *G07F 11/005* (2013.01); *G07F 11/165* (2013.01)

(56) References Cited

FOREIGN PATENT DOCUMENTS

| | | | | |
|---|---|---|---|---|
| CN | 103886682 | A | 6/2014 | |
| CN | 104424708 | A | 3/2015 | |
| CN | 105184972 | A | 12/2015 | |
| CN | 205563817 | U | 9/2016 | |
| CN | 206133784 | U | 4/2017 | |
| EP | 2587460 | A1 * | 5/2013 | ..... G07F 11/04 |
| JP | 2001023013 | A | 1/2001 | |
| JP | 2005196576 | A | 7/2005 | |

OTHER PUBLICATIONS

International Search Report dated Dec. 26, 2018, in the International Application PCT/CN2018/106665. 5 pages.

* cited by examiner

VENDING MACHINE AND GOODS DELIVERY METHOD

CROSS REFERENCE TO RELATED APPLICATIONS

This application is a national stage application of International Patent Application No. PCT/CN2018/106665, filed on Sep. 20, 2018, which claims priority to and benefit of Chinese Patent Application No. 201711470549.7, which was filed with the State Intellectual Property Office of the People's Republic of China on Dec. 29, 2017, the disclosures of both of which are incorporated herein by reference in their entireties.

TECHNICAL FIELD

The present disclosure relates to the field of automatic vending, such as a vending machine and a commodity conveying method.

BACKGROUND

In recent years, as a variety of commodities such as groceries, fruits, vegetables and beverages can be sold in vending machines, the vending machines are becoming increasingly popular.

A vending machine is provided in the related art; when a consumer purchases a commodity, the bucket of the vending machine receives the commodity from the storage column and conveys the commodity to the pickup port, and the consumer can take the commodity out of the pickup port. However, in case of strip-shaped commodity (such as bottled water), the commodity may topple in the bucket when entering the bucket, and the toppled commodity may extend to the outside of the bucket and collide with other structures in the vending machine, thus affecting the movement of the bucket.

SUMMARY

The present disclosure provides a vending machine to prevent the commodity from extending to the outside of the bucket when entering the bucket, so as to avoid the commodity to be conveyed colliding with other structures of the vending machine, and further ensure the normal movement of the bucket.

The present disclosure also provides a commodity conveying method to prevent the commodity from extending to the outside of the bucket when entering the bucket, so as to avoid the commodity to be conveyed colliding with other structures of the vending machine, and further ensure the normal movement of the bucket.

In an embodiment, the present disclosure provides a vending machine, including:

a cabinet, where a pickup port is arranged at the surface of the cabinet;

a storage column arranged in the cabinet, configured to store the commodities;

a bucket arranged in the cabinet, configured to convey the commodity between the storage column and the pickup port; the bucket includes an inlet and an outlet which are oppositely arranged; the inlet is configured to be butted with the storage column so that the commodity to be conveyed in the storage column can enter the bucket through the inlet; and the outlet is configured to be butted with the pickup port;

a bucket drive mechanism, in transmission connection with the bucket, configured to drive the bucket to move in the cabinet;

a first shutter mechanism arranged at the inlet, configured to block or open the inlet;

a second shutter mechanism arranged at the outlet, configured to block or open the outlet; and a controller, where the first shutter mechanism and the second shutter mechanism are both electrically connected with the controller; the controller is configured to control the first shutter mechanism to open the inlet and the second shutter mechanism to block the outlet in the process of the commodity to be conveyed entering the bucket.

In an embodiment, the present disclosure also provides a commodity conveying method for a vending machine, where the vending machine includes a cabinet, a bucket, a bucket drive mechanism, a first shutter mechanism, a second shutter mechanism and a storage column; a pickup port is arranged at the surface of the cabinet; the bucket, the bucket drive mechanism and the storage column are arranged in the cabinet; the bucket is configured to convey the commodity between the storage column and the pickup port, including an inlet and an outlet oppositely arranged; the first shutter mechanism is arranged at the inlet, the second shutter mechanism is arranged at the outlet, and the bucket drive mechanism is configured to drive the bucket to move in the cabinet;

the method including:

controlling the bucket drive mechanism to drive the bucket to move towards the storage column;

controlling the first shutter mechanism to open the inlet and the second shutter mechanism to block the outlet when the inlet is butted with the storage column.

In the figure: 100—vending machine; 101—cabinet; 103—pickup port; 105—storage column; 107—bucket; 109—cabinet body; 111—cabinet door; 113—storage column outlet; 115—inlet; 117—outlet; 119—storage device; 121—bucket drive mechanism; 123—first shutter mechanism; 125—second shutter mechanism; 127—first detecting member; 129—third sensor; 131—second detecting member; 133—fourth sensor; 143—first shutter; 145—second shutter.

DETAILED DESCRIPTION

The following descriptions of embodiments of the present disclosure are not intended to limit the scope of the claimed disclosure, but merely represent some embodiments of the disclosure. Similar numbers and letters refer to similar items in the following drawings. Therefore, if an item is defined in one drawing, such item will not be defined or explained in the subsequent drawings.

In the descriptions of the present disclosure, the words "first", "second", "third" and "fourth" are only used for distinguishing descriptions, and cannot be understood as indicating or implying relative importance.

Embodiment 1

Figure 1:
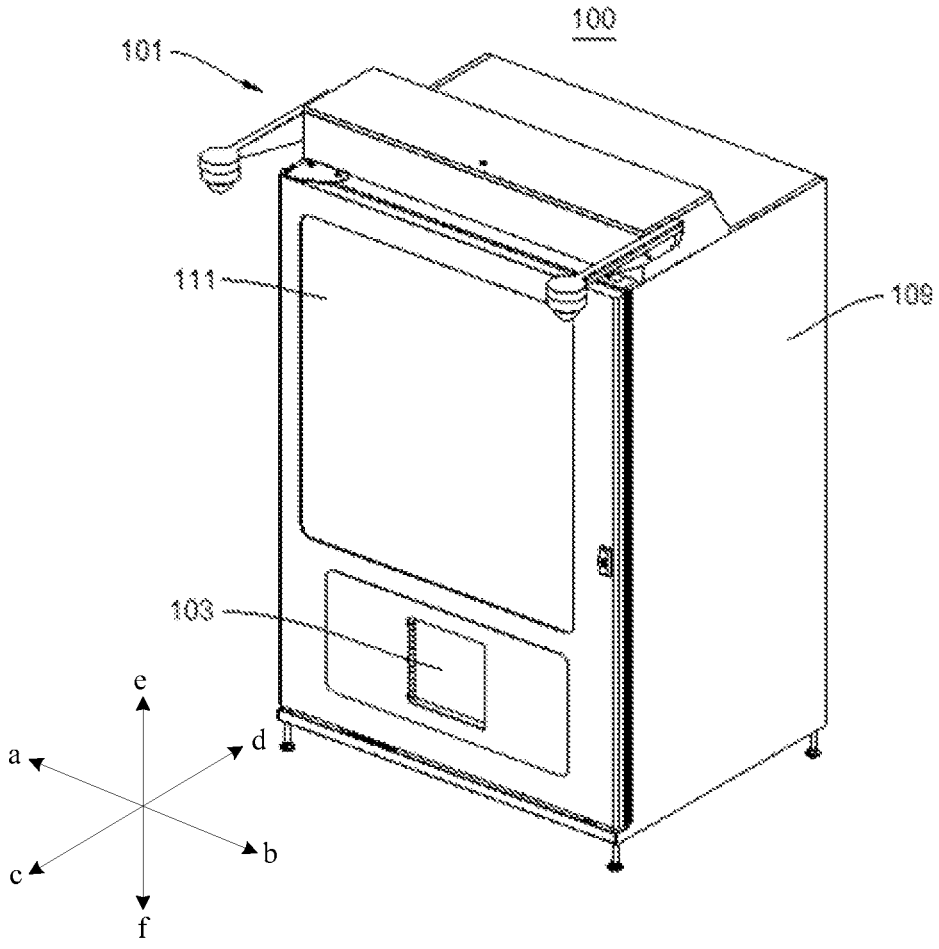
FIG. 1 is a structural view of a vending machine in a first state according to an embodiment of the present disclosure.
Figure 2:
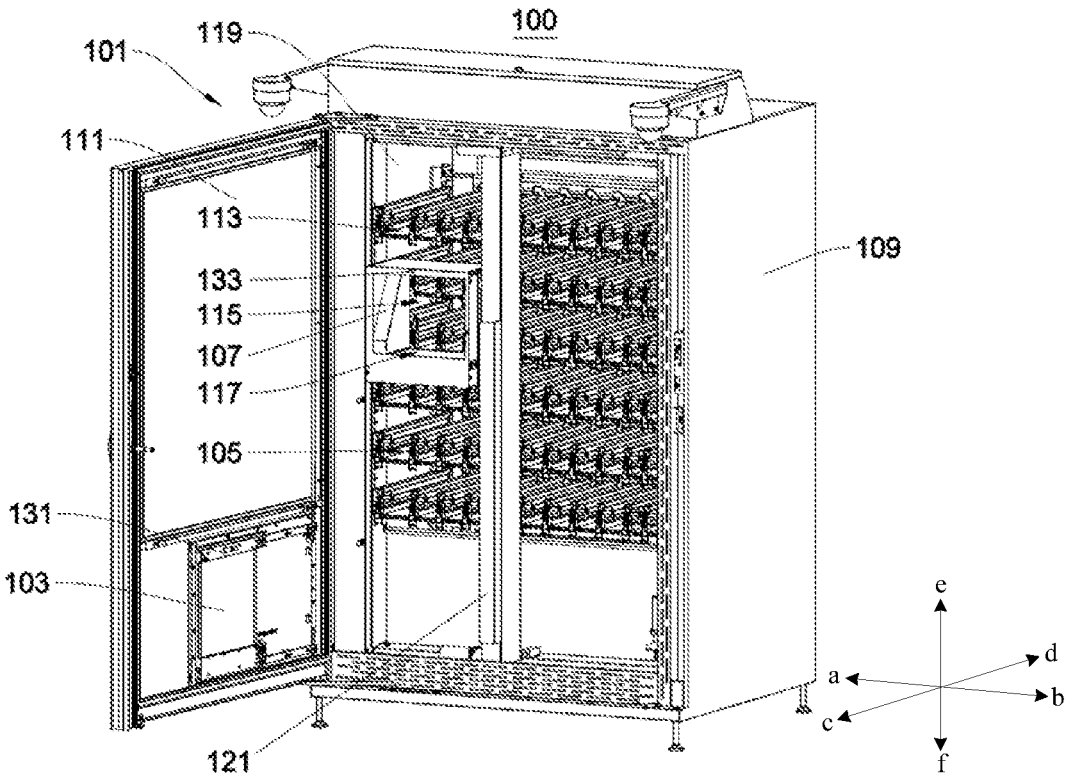
FIG. 2 is a structural view of the vending machine in a second state according to an embodiment of the present disclosure.

FIG. 1 is a structural view of a vending machine in a first state according to the embodiment. FIG. 2 is a structural view of the vending machine in a second state according to the embodiment. As shown in FIG. 1 and FIG. 2, in the embodiment, the vending machine 100 includes a cabinet 101, and multiple storage columns 105, a bucket 107, a bucket drive mechanism 121, a first shutter mechanism 123 (FIG. 4), a second shutter mechanism 125 (FIG. 4) and a controller, all of which are arranged in the cabinet 101.

As also shown in FIG. 1 and FIG. 2, the cabinet 101 includes a cabinet body 109, a cabinet door 111, and a storage device 119. The cabinet door 111 is rotatably connected with the cabinet body 109. A pickup port 103 is arranged at the surface of the cabinet door 111. The cabinet door 111 may be made of transparent materials to facilitate the display of the commodities in the cabinet body 109. The storage device 119 is arranged in the cabinet 109, and opposite to the cabinet door 111.

The storage column 105 is arranged in the storage device 119, and the length direction of the storage column 105 extends in a first horizontal direction indicated by an arrow cd. A storage column outlet 113 is arranged at the front end of the storage column 105, and the storage column outlet 113 is adjacent to the cabinet door 111. The vending machine 100 further includes a commodity delivery mechanism configured to convey the commodity in the storage column 105 and discharge the commodity from the storage column outlet 113. In the embodiment, the commodity delivery mechanism is arranged in the storage column 105.

Figure 3:
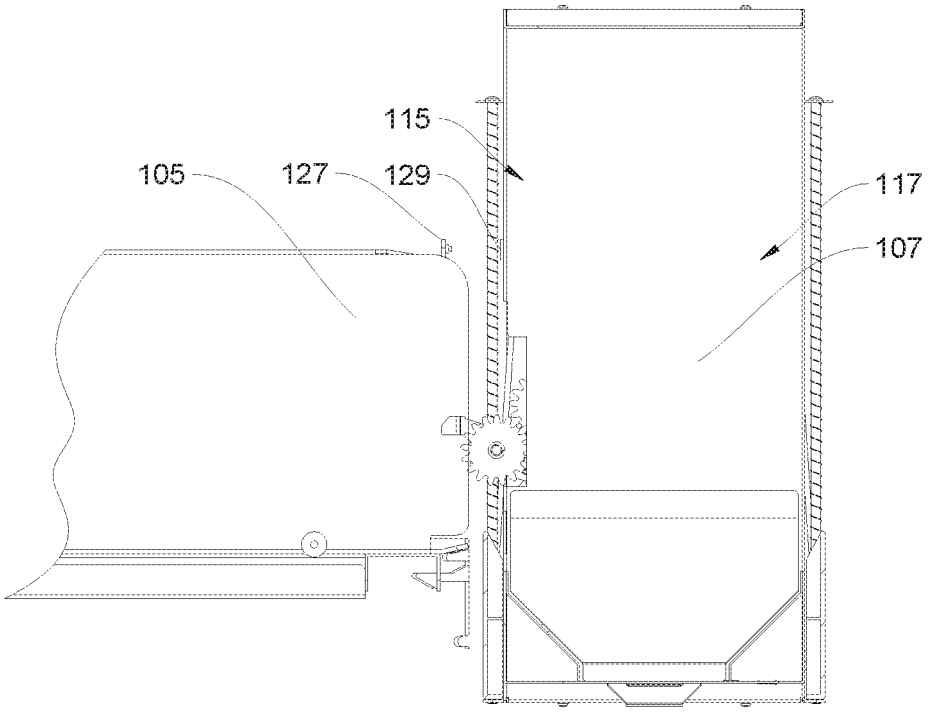
FIG. 3 is a schematic diagram of the butting of a storage column and a bucket of the vending machine according to an embodiment of the present disclosure.

As also shown in FIG. 1 and FIG. 2, the bucket 107 is arranged in the cabinet body 109, and located between the cabinet door 111 and the storage device 119. The front end of the bucket 107 is provided with an outlet 117, and the rear end of the bucket 107 is provided with an inlet 115. The bucket drive mechanism 121 is arranged in the cabinet body 109, and located between the cabinet door 111 and the storage device 119. The bucket drive mechanism 121 is in transmission connection with the bucket 107, and configured to drive the bucket 107 to move in a vertical direction indicated by an arrow of and/or a second horizontal direction indicated by an arrow ab, so that the inlet 115 of the bucket 107 can be opposite to the storage column outlet 113 of any storage column 105, or the outlet 117 of the bucket 107 can be opposite to the pickup port 103. FIG. 3 is a schematic diagram for the butting of a storage column and a bucket of the vending machine according to the embodiment. As shown in FIG. 2 and FIG. 3, when the inlet 115 of the bucket 107 is opposite to the storage column outlet 113 of any storage column 105, the commodity to be conveyed in the storage column 105 can be conveyed into the bucket 107 by the commodity delivery mechanism. When the outlet 117 of the bucket 107 is opposite to the pickup port 103, the consumer can take the commodity out of the bucket 107.

Figure 4:
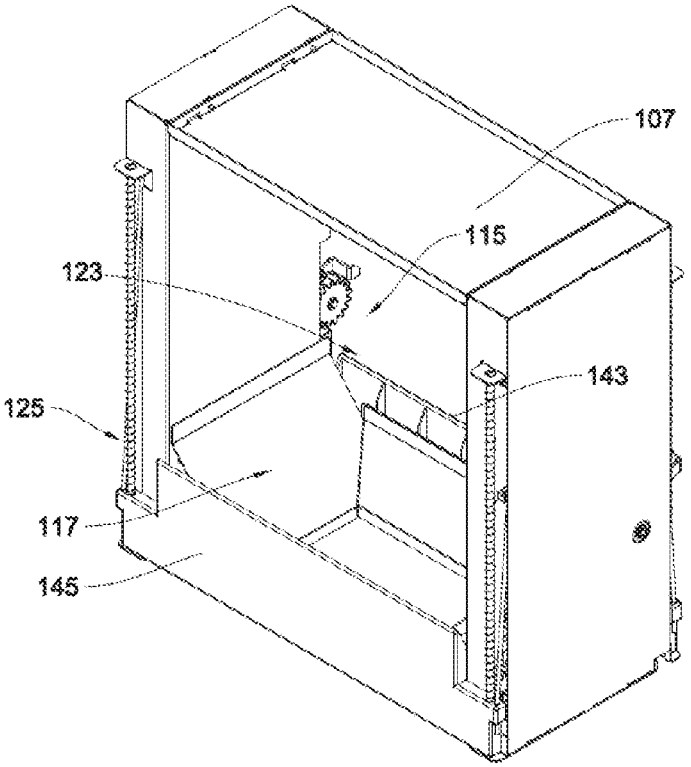
FIG. 4 is a structural view of a bucket of the vending machine according to an embodiment of the present disclosure.

FIG. 4 is a structural view of a bucket of the vending machine according to the embodiment. As shown in FIG. 4, in the embodiment, the first shutter mechanism 123 is arranged at the inlet 115 and is configured to block or open the inlet 115; and the second shutter mechanism 125 is arranged at the outlet 117 and is configured to block or open the outlet 117. The first shutter mechanism 123 includes a first shutter 143, the second shutter mechanism 125 includes a second shutter 145, and the first shutter mechanism 123 and the second shutter mechanism 125 further include a power assembly respectively; both ends of the first shutter 143 and those of the second shutter 145 are respectively in transmission connection with the corresponding power assembly. Each power assembly is configured to correspondingly drive the first shutter 143 or the second shutter 145 to move in the vertical direction; where the first shutter 143 can at least partially block the inlet 115 by moving from bottom to top, and can completely open the inlet 115 by moving from top to bottom; the second shutter 145 can at least partially block the outlet 117 by moving from bottom to top, and can completely open the outlet 117 by moving from top to bottom. The power assemblies can transmit power through the meshing transmission of gears or through other transmission modes; the transmission mode will not be limited in the disclosure.

In the embodiment, the first shutter mechanism 123 is configured to block or open the inlet 115, and the second shutter mechanism 125 is configured to block or open the outlet 117. Blocking may refer to complete blocking or partial blocking, and opening refers to complete opening only.

Figure 5:
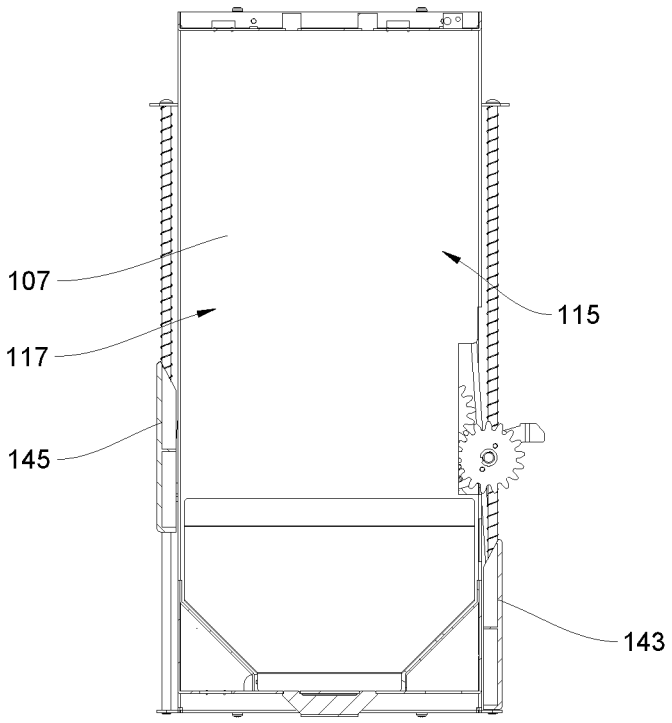
FIG. 5 is a structural view of a bucket of the vending machine in a stock-in state according to an embodiment of the present disclosure.

In the embodiment, the controller is electrically connected with the power assembly of the first shutter mechanism 123 and that of the second shutter mechanism 125, and is configured to control the first shutter mechanism 123 to open the inlet 115 and the second shutter mechanism 125 to block the outlet 117 in the process that the commodity to be conveyed is entering the bucket 107. For example, after receiving a commodity purchase instruction, the controller controls the bucket drive mechanism 121 to drive the bucket 107 to move towards the storage column 105 in which the commodity is. When the inlet 115 is butted with the storage column outlet 113, the corresponding power assembly drives the first shutter 143 to move downwards to open the inlet 115, and the second shutter 145 to move upwards to block the outlet 117. In an embodiment, controlling of the movement of the first shutter mechanism 123 and the second shutter mechanism 125 by the controller can be understood as a continuous action. For example, in the above process, the controller controls the first shutter 143 to remain in a state of opening the inlet 115 and the second shutter 145 to remain in a state of blocking the outlet 117. In an embodiment, when the controller is going to control the first shutter mechanism 123 to open the inlet 115, if the first shutter 143 is already in a state of opening the inlet 115, the controller will not control the first shutter 143 to move. When the controller is going to control the second shutter mechanism 125 to block the outlet 117, if the second shutter 145 is already in a state of blocking the outlet 117, the controller will not control the second shutter 145 to move. Then, the controller controls the commodity delivery mechanism to convey the commodity to be conveyed into the bucket 107. In the process that the commodity to be conveyed is entering the bucket 107, as being blocked by the second shutter 145, the commodity to be conveyed are not easy to topple or extend to the outside of the bucket 107, so as to avoid the commodity to be conveyed colliding with other structures of the vending machine 100, and further ensure the normal movement of the bucket 107. As shown in FIG. 3, in an embodiment, the storage column 105 is provided with a first detecting member 127, and the bucket 107 is provided with a third sensor 129. The third sensor 129 is electrically connected with the controller, and is configured to be coupled with the first detecting member 127 and send a first detecting signal when being coupled with the first detecting member 127. The controller is configured to receive the first detecting signal, and determine whether the bucket 107 arrives at a position opposite to a storage column 105 upon receiving the corresponding first detecting signal. At this moment, the controller controls the first shutter mechanism 123 to open the inlet 115 and the second shutter mechanism 125 to block the outlet 117. FIG. 5 is a structural view of a bucket of the vending machine in a stock-in state according to the embodiment. As shown in FIG. 5, when the inlet 115 is opposite to the storage column outlet 113, the first detecting member 127 is coupled with the third sensor 129, and the third sensor 129 sends a first detecting signal. The controller controls the power assemblies to drive the first shutter 143 to open the inlet 115 and the second shutter 145 to block the outlet 117 according to the first detecting signal, and then, the commodities are conveyed into the bucket 107. Then, the controller controls the bucket drive mechanism 121 to drive the bucket 107 to move towards the pickup port 103. In an embodiment, the first detecting member 127 may also be arranged on the bucket 107, and the third sensor 129 may also be arranged on the storage column 105.

In an embodiment, a first sensor (not shown in the figure) may also be provided at the inlet 115 of the bucket 107; the first sensor is electrically connected with the controller, and configured to detect whether the commodity to be conveyed completely enters the bucket 107; when the first sensor detects that the commodity to be conveyed completely enters the bucket 107, the first sensor outputs a corresponding detecting signal, and the controller controls the first shutter 143 to block the inlet 115 according to such signal.

Figure 6:
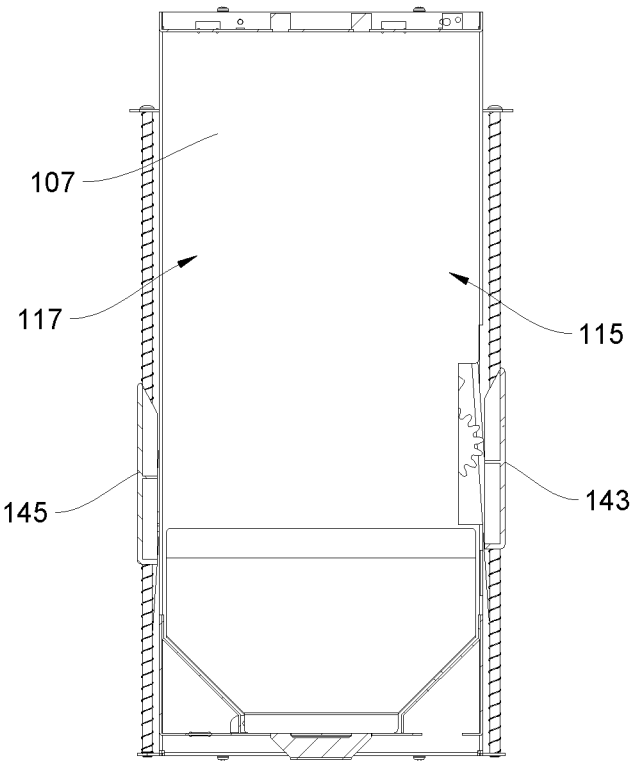
FIG. 6 is a structural view of a bucket of the vending machine in a conveying state according to an embodiment of the present disclosure.

FIG. 6 is a structural view of a bucket of the vending machine in a conveying state according to the embodiment. As shown in FIG. 6, in an embodiment, after the commodity to be conveyed enters the bucket 107, the bucket drive mechanism 121 drives the bucket 107 to move towards the pickup port 103. In this case, before the bucket 107 moves towards the pickup port 103, the controller controls the power assemblies to drive the first shutter 143 to block the inlet 115, and the second shutter 145 to block the outlet 117. During the movement of the bucket 107 to the pickup port 103, the commodity to be conveyed are blocked by the first shutter 143 and the second shutter 145; thus, the commodity is not easy to topple due to the vibration in the process of conveying, and the commodity with a toppling tendency can be righted to prevent further toppling, so as to effectively avoid the collision of the commodity to be conveyed with other parts of the vending machine 100 such as the storage column 105 and the cabinet door 111, and further ensure the normal movement of the bucket 107. In an embodiment, since the second shutter 145 is already in a state of blocking the outlet 117 during the process that the commodity to be conveyed is entering the bucket 107, the controller will not control the second shutter 145 to move after the commodity to be conveyed enters the bucket 107 and before the bucket 107 moves towards the pickup port 103.

In an embodiment, the controller may also be configured to set the time for controlling the bucket drive mechanism 121 to drive the bucket 107 to start moving. For example, the controller may wait for a preset time after controlling the power assemblies to drive the first shutter 143 to block the inlet 115 and the second shutter 145 to block the outlet 117, and then control the bucket drive mechanism 121 to start driving the bucket 107 to move in the cabinet 101. The preset time may be 10 s, 20 s or shorter, and the preset time will not be limited in the disclosure. After a wait of the preset time, the commodity to be conveyed that have just been conveyed into the bucket 107 are stabilized, so as to avoid the toppling of the commodity to be conveyed.

Figure 7:
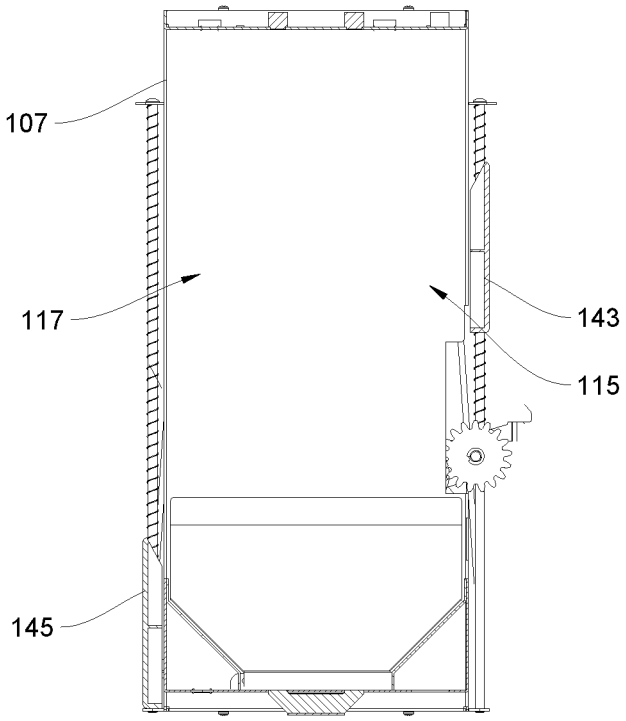
FIG. 7 is a structural view of a bucket of the vending machine in a dispensing state according to an embodiment of the present disclosure.

FIG. 7 is a structural view of a bucket of the vending machine in a dispensing state according to an embodiment of the present disclosure. As shown in FIG. 7, when the commodity to be conveyed enters the bucket 107, the bucket drive mechanism 121 drives the bucket 107 to move towards the pickup port 103; when the bucket 107 arrives at the position opposite to the pickup port 103 and the outlet 117 of the bucket 107 is butted with the pickup port 103, the controller can control the power assemblies to drive the first shutter 143 to block the inlet 115 and the second shutter 145 to open the outlet 117. When the first shutter 143 blocks the inlet 115, the consumer cannot obtain the commodity in the storage column 105 opposite to the inlet 115 through the inlet 115 of the bucket 107, and the safety of the vending machine 100 is improved. When the second shutter 145 opens the outlet 117, the consumer can take out the commodity to be conveyed in the bucket 107. In an embodiment, since the first shutter 143 is in a state of blocking the inlet 115 in the process of the bucket 107 conveying the commodity to the pickup port 102 from the storage column 105, the controller will not control the first shutter mechanism 115 to move when the outlet 117 of the bucket 107 is butted with the pickup port 103.

In an embodiment, as shown in FIG. 2, a second detecting member is arranged at the pickup port 103, and the bucket 107 is provided with a fourth sensor 133. The fourth sensor 133 is electrically connected with the controller and is configured to be coupled with the second detecting member 131 and send a second detecting signal when being coupled with the second detecting member 131. The controller is configured to receive the second detecting signal, and control the first shutter mechanism 123 to block the inlet 115 and the second shutter mechanism 125 to open the outlet 117 upon receiving the second detecting signal. When the outlet 117 is opposite to the pickup port 103, the second detecting member 131 is coupled with the fourth sensor 133, and the fourth sensor 133 sends a second detecting signal; the controller controls the power assemblies to drive the first shutter 143 to block the inlet 115, and the second shutter 145 to open the outlet 117 according to the second detecting signal, so that the consumer can take the commodity in the bucket 107 through the pickup port 103. In other embodiments of the present disclosure, the second detecting member 131 may also be arranged on the bucket 107, and the fourth sensor 133 may also be arranged at the pickup port 103.

A second sensor (not shown in the figure) may also be provided in the bucket 107. The second sensor is configured to detect the height of the commodity to be conveyed entering the bucket 107, and electrically connected with the controller; the controller is configured to adjust the height of the first shutter 143 when the first shutter 143 blocks the inlet 115 and the height of the second shutter 145 when the second shutter 145 blocks the outlet 117 according to the height of the commodity to be conveyed entering the bucket 107 detected by the second sensor. Therefore the rising heights of the first shutter 143 and the second shutter 145 can respectively be automatically adjusted according to the height of the commodity to be conveyed so as to be applicable to the conveying of commodity of different height.

Embodiment 2

It should be noted that in this paper, the height of the first shutter mechanism 123 when the first shutter mechanism 123 blocks the inlet 115 refers to the height of the first shutter 143 when the first shutter 143 blocks the inlet 115, the height of the second shutter mechanism 125 when the second shutter mechanism 125 blocks the outlet 117 refers to the height of the second shutter 145 when the second shutter 145 blocks the outlet 117.

Figure 8A:
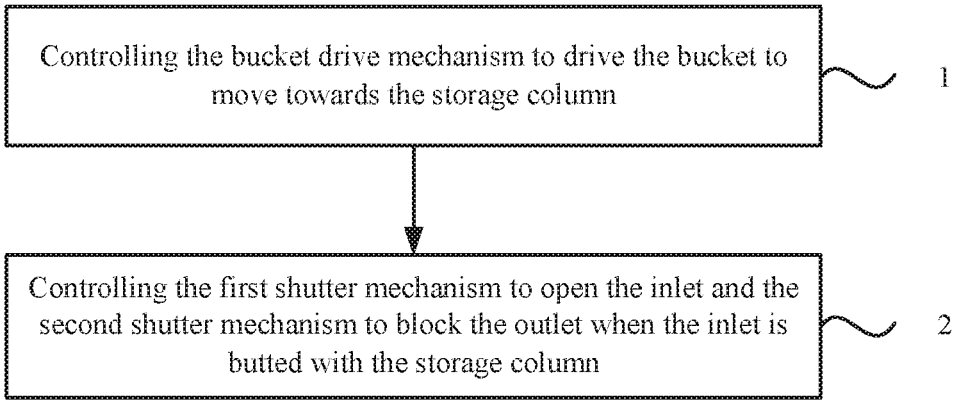
FIG. 8*a* is a flow chart of a commodity conveying method according to an embodiment of the present disclosure.

The embodiment provides a commodity conveying method for the vending machine 100, where the vending machine 100 includes a cabinet 101, a bucket 107, a bucket drive mechanism 121, a first shutter mechanism 123, a second shutter mechanism 125 and a storage column 105. The cabinet 101 is provided with a pickup port 103, and the bucket 107 and the storage column 105 are arranged in the cabinet 101; the bucket 107 is configured to convey the commodity between the storage column 105 and the pickup port 103, including an inlet 115 and an outlet 117 oppositely arranged; the first shutter mechanism 123 is arranged at the inlet 115, the second shutter mechanism 125 is arranged at the outlet 117, and the bucket drive mechanism 121 is configured to drive the bucket 107 to move in the cabinet 101. FIG. 8A is a flow chart of a commodity conveying method according to the embodiment. As shown in FIG. 8A, the commodity conveying method including:

Step 1: controlling the bucket drive mechanism to drive the bucket to move towards the storage column.

Where, when the vending machine 100 in Embodiment 1 is adopted, after the consumer selects a commodity, the controller controls the bucket drive mechanism 121 to drive the bucket 107 to move towards the storage column 105 in which the commodity is, so that the inlet 115 of the bucket 107 can be opposite to the storage column outlet 113 of the storage column 105.

In an embodiment, the cabinet 101 of the vending machine 100 includes multiple storage columns. When the consumer selects a commodity, the controller determines one of the storage columns as the target storage column according to the commodity selected by the consumer, and controls the bucket drive mechanism 121 to drive the bucket 107 to move towards the target storage column.

Step 2: controlling the first shutter mechanism to open the inlet and the second shutter mechanism to block the outlet when the inlet is butted with the storage column.

When the inlet 115 is butted with the storage column outlet 113 of the storage column 105, the controller controls the first shutter mechanism 123 to open the inlet 115 and the second shutter mechanism 125 to block the outlet 117 to make full preparation for conveying the commodity to be conveyed into the bucket 107; and thus, when the commodity to be conveyed is conveyed into the bucket 107 from the storage column 105, the commodity to be conveyed are prevented from toppling due to being blocked by the second shutter mechanism 125 to prevent the commodity to be conveyed from extending to the outside of the bucket 107.

Figure 8B:
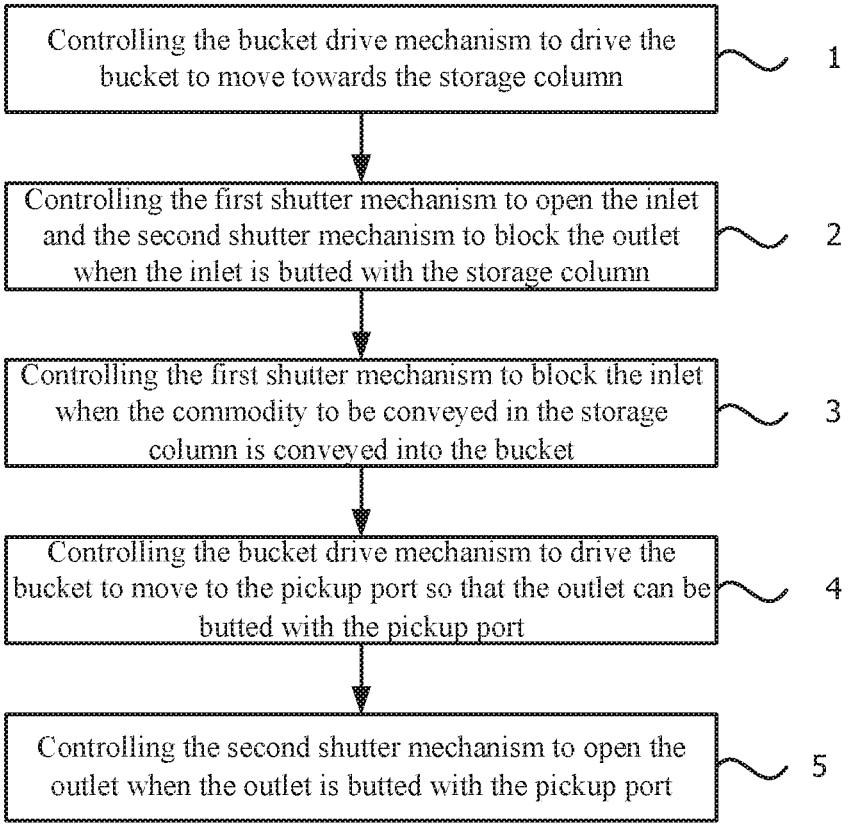
FIG. 8*b* is a flow chart of another commodity conveying method according to an embodiment of the present disclosure.

In an embodiment, FIG. 8B is a flow chart of another commodity conveying method according to an embodiment of the present disclosure; as shown in FIG. 8B, the method according to the present disclosure further includes:

Step 3: controlling the first shutter mechanism to block the inlet when the commodity to be conveyed in the storage column is conveyed into the bucket.

In an embodiment, when the inlet 115 is butted with the storage column outlet 113 of the storage column 105 and the first shutter mechanism 123 opens the inlet 115, the controller controls the commodity delivery mechanism to convey the commodity to be conveyed into the bucket 107 through the storage column outlet 113 of the storage column 105. When it is detected that the commodity to be conveyed in the storage column 105 is conveyed into the bucket 107 (namely, when it is detected that the commodity to be conveyed completely enters the bucket 107), the controller controls the first shutter mechanism 123 to block the inlet 115 to make preparation for the bucket 107 conveying the commodity to be conveyed.

Step 4: controlling the bucket drive mechanism to drive the bucket to move to the pickup port, so that the outlet can be butted with the pickup port.

In an embodiment, after the commodity to be conveyed in the storage column 105 is conveyed into the bucket 107 and the first shutter mechanism 123 closes the inlet 115 and the second shutter mechanism 125 closes the outlet 117, the controller controls the bucket drive mechanism 121 to drive the bucket 107 to move to the pickup port 103 so that the outlet 117 can be butted with the pickup port 103.

The first shutter mechanism 123 closes the inlet 115 and the second shutter mechanism 125 closes the outlet 117 when the bucket 107 conveys the commodity to be conveyed; therefore, during the movement of the bucket 107 to the pickup port 103, the commodity to be conveyed are blocked by the first shutter 143 and the second shutter 145; thus, the commodity is not easy to topple due to the vibrication in the process of conveying, and the commodity with a toppling tendency can be righted to prevent further toppling, so as to effectively avoid the collision of the commodity to be conveyed with other parts of the vending machine 100 such as the storage column 105 and the cabinet door 111, and further ensure the normal movement of the bucket 107.

Step 5: controlling the second shutter mechanism to open the outlet when the outlet is butted with the pickup port.

When the outlet 117 is butted with the pickup port 103, the controller controls the second shutter mechanism 125 to open the outlet 117. Since the first shutter mechanism 123 blocks the inlet 115 and the second shutter mechanism 125 opens the outlet 117, at this moment, the consumer can smoothly take the commodity in the bucket 107 through the outlet 117, but cannot obtain the commodity in the storage column 105 opposite to the inlet 115 through the inlet 115, and the safety of the vending machine 100 is improved.

Figure 9:
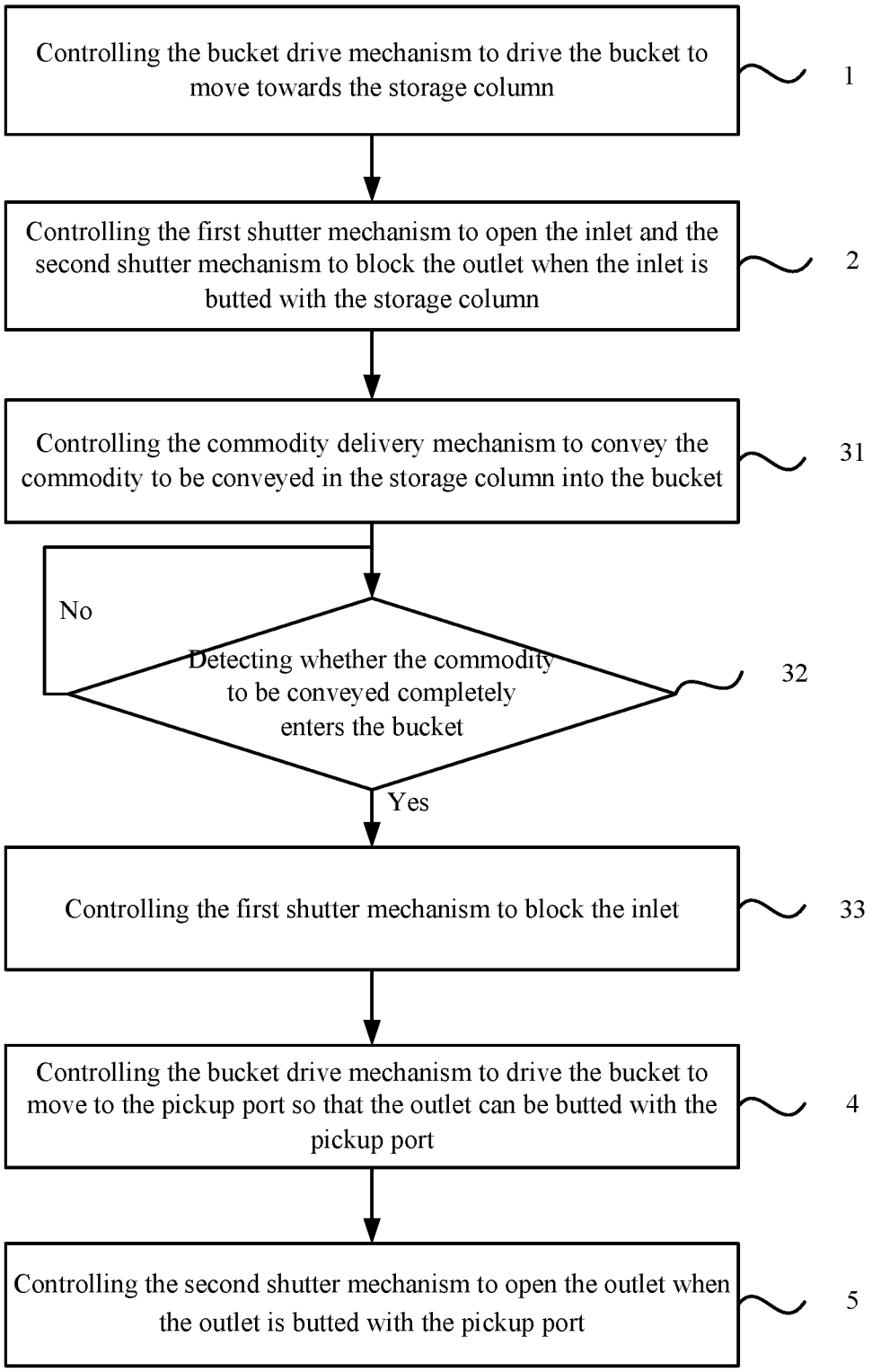
FIG. 9 is a flow chart of an additional other commodity conveying method according to an embodiment of the present disclosure.

In an embodiment, FIG. 9 is a flow chart of an additional other commodity conveying method according to the embodiment. As shown in FIG. 9, the process for controlling the bucket 107 to move to the pickup port 103 including:

Step 1: controlling the bucket drive mechanism to drive the bucket to move towards the storage column.

Step 2: controlling the first shutter mechanism to open the inlet and the second shutter mechanism to block the outlet when the inlet is butted with the storage column.

Step 31: controlling the commodity delivery mechanism to convey the commodity to be conveyed in the storage column to the bucket.

Step 32: detecting whether the commodity to be conveyed completely enters the bucket; if the commodity to be conveyed completely enters the bucket, perform Step 33; if the commodity to be conveyed does not completely enter the bucket, continue to perform Step 32.

The vending machine 100 according to the embodiment of the present disclosure is taken as an example; the first sensor is used to detect whether the commodity to be conveyed completely enters the bucket 107.

Step 33: controlling the first shutter mechanism to block the inlet.

In an embodiment, the process may further include detecting the height of the commodity to be conveyed after the commodity to be conveyed enters the bucket 107, and adjusting the blocking height of the first shutter mechanism 123 after being raised according to the detected height, and the blocking height of the second shutter mechanism 125 after being raised according to the detected height. In an embodiment, the blocking height of the first shutter mechanism 123 after being raised refers to the height of the first shutter 143 when the first shutter 143 rises and blocks the inlet 115, and the blocking height of the second shutter mechanism 125 after being raised refers to the height of the second shutter 145 when the second shutter 145 rises and blocks the outlet 117.

By controlling the first shutter mechanism 123 to block the inlet 115 after the commodity to be conveyed completely enters the bucket, the first shutter mechanism 123 blocks the inlet 115 and the second shutter mechanism 125 blocks the outlet 117 in the process of conveying the commodity to be conveyed from the storage column 105 to the pickup port 103 by the bucket 107; thus, the commodity to be conveyed are blocked and restricted by the first shutter mechanism 123 and the second shutter mechanism 125 in the process of conveying, so that such commodity is not easy to topple or extend to the outside of the bucket 107 due to the fluctuation in the process of conveying, and the commodity to be conveyed with a toppling tendency can be righted to prevent further toppling, so as to effectively avoid the collision of the commodity to be conveyed with other parts of the vending machine 100 such as the storage column 105 and the cabinet door 111, and further ensure the normal movement of the bucket 107.

Where, the controller may wait for a preset time after controlling the first shutter mechanism 123 to block the inlet 115, and then control the bucket 107 to move to the pickup port 103. After a wait of the preset time, the commodity to be conveyed that have just been conveyed into the bucket 107 are stabilized, so as to avoid the toppling of the commodity to be conveyed.

Step 4: controlling the bucket drive mechanism to drive the bucket to move to the pickup port, so that the outlet can be butted with the pickup port.

Step 5: controlling the second shutter mechanism to open the outlet when the outlet is butted with the pickup port.

In the embodiment of the present disclosure, in case the vending machine 100 described in Embodiment 1 is adopted, when the consumer determines to purchase the commodity, the controller controls the bucket drive mechanism 121 to drive the bucket 107 to move towards the target bucket; when the inlet 115 is opposite to the storage column outlet 113 of the target bucket, the controller controls the first shutter mechanism 123 to open the inlet 115 and the second shutter mechanism 125 to block the outlet 117, so that the commodity to be conveyed can be smoothly conveyed into the bucket 107 and the commodity to be conveyed is prevented from extending out of the bucket 107. After the commodity to be conveyed enters the bucket 107, the controller controls the first shutter mechanism 123 to close the inlet 115 and the second shutter mechanism 125 to close the outlet 117, and then controls the bucket drive mechanism 121 to drive the bucket 107 to move towards the pickup port 103, so as to ensure the stability of the commodity to be conveyed in the conveying process, avoid the toppling of the commodity to be conveyed, and further prevent the toppled commodity to be conveyed from colliding with other parts such as the cabinet door 111 and the storage column 105. When the outlet 117 is butted with the pickup port 103, the controller controls the first shutter mechanism 123 to block the inlet 115 and the second shutter mechanism 125 to open the outlet 117, the consumer can smoothly take the commodity out of the bucket 107, but cannot obtain the commodity in the storage column 105 opposite to the inlet 115 through the inlet 115 of the bucket 107, and the safety of the vending machine 100 is improved.

What is claimed is:

1. A vending machine, comprising:

a cabinet, wherein a pickup port is arranged at the surface of the cabinet;

a storage column arranged in the cabinet, configured to store the commodities;

a bucket arranged in the cabinet, configured to convey commodities between the storage column and the pickup port, wherein the bucket comprises an inlet and an outlet which are oppositely arranged, wherein the inlet is configured to be butted with the storage column so that the commodity to be conveyed in the storage column can enter the bucket through the inlet, and wherein the outlet is configured to be butted with the pickup port;

a bucket drive mechanism, in transmission connection with the bucket, configured to drive the bucket to move in the cabinet;

a first shutter mechanism arranged at the inlet, configured to block or open the inlet;

a second shutter mechanism arranged at the outlet, configured to block or open the outlet; and a controller, wherein the first shutter mechanism and the second shutter mechanism are both electrically connected with the controller, wherein the controller is configured to control the first shutter mechanism to open the inlet and the second shutter mechanism to block the outlet in the process of the commodity to be conveyed entering the bucket.

2. The vending machine according to claim 1, wherein the controller is further configured to control the first shutter mechanism to block the inlet and the second shutter mechanism to block the outlet in the process of the bucket conveying the commodity to be conveyed from the storage column to the pickup port.

3. The vending machine according to claim 2, wherein a first sensor is arranged at the inlet of the bucket, wherein the first sensor is electrically connected with the controller, and the first sensor is configured to detect whether the commodity to be conveyed completely enters the bucket, wherein the controller is further configured to control the first shutter mechanism to block the inlet when the first sensor detects that the commodity to be conveyed completely enters the bucket.

4. The vending machine according to claim 1, wherein the controller is further configured to control the first shutter mechanism to block the inlet and the second shutter mechanism to open the outlet when the outlet is butted with the pickup port.

5. The vending machine according to claim 1, wherein a second sensor is arranged in the bucket, wherein the second sensor is configured to detect the height of the commodity to be conveyed entering the bucket, and the second sensor is electrically connected with the controller, wherein the controller is further configured to adjust the height of the first shutter mechanism when the first shutter mechanism blocks the inlet and the height of the second shutter mechanism when the second shutter mechanism blocks the outlet according to the height of the commodity to be conveyed entering the bucket.

6. A commodity conveying method for a vending machine, wherein the vending machine comprises a cabinet, a bucket, a bucket drive mechanism, a first shutter mechanism, a second shutter mechanism and a storage column, wherein a pickup port is arranged at the surface of the cabinet, wherein the bucket, the bucket drive mechanism and the storage column are arranged in the cabinet, wherein the bucket is configured to convey commodities between the storage column and the pickup port, comprising an inlet and an outlet oppositely arranged, wherein the first shutter mechanism is arranged at the inlet, the second shutter mechanism is arranged at the outlet, and the bucket drive mechanism is configured to drive the bucket to move in the cabinet, the method comprising:

controlling the bucket drive mechanism to drive the bucket to move towards the storage column; and controlling the first shutter mechanism to open the inlet and the second shutter mechanism to block the outlet when the inlet is butted with the storage column.

7. The method according to claim 6, further comprising:

controlling the first shutter mechanism to block the inlet when it is determined that the commodity to be conveyed in the storage column is conveyed into the bucket; and controlling the bucket drive mechanism to drive the bucket to move to the pickup port so that the outlet can be butted with the pickup port.

8. The method according to claim 7, wherein the vending machine further comprises a first sensor configured to detect whether the commodity to be conveyed completely enters the bucket; the method further comprising:

judging whether the commodity to be conveyed in the storage column completely enters the bucket according to a signals output by the first sensor; and determining the commodity to be conveyed in the storage column is conveyed into the bucket when it is determined that the commodity to be conveyed completely enters the bucket.

9. The method according to claim 7, further comprising:

controlling the second shutter mechanism to open the outlet when the outlet is butted with the pickup port.

10. The method according to claim 6, wherein the vending machine further comprises a second sensor configured to detect the height of the commodity to be conveyed entering the bucket, the method further comprising:

determining the height of the commodity to be conveyed entering the bucket according to signals output by the second sensor, and adjusting the height of the first shutter mechanism when the first shutter mechanism blocks the inlet and the height of the second shutter mechanism when the second shutter mechanism blocks the outlet according to the height.

11. The vending machine according to claim 1, wherein a first sensor is arranged at the inlet of the bucket, wherein the first sensor is electrically connected with the controller, and the first sensor is configured to detect whether the commodity to be conveyed completely enters the bucket, wherein the controller is further configured to control the first shutter mechanism to block the inlet when the first sensor detects that the commodity to be conveyed completely enters the bucket.

12. The vending machine according to claim 2, wherein the controller is further configured to control the first shutter mechanism to block the inlet and the second shutter mechanism to open the outlet when the outlet is butted with the pickup port.

13. The vending machine according to claim 3, wherein the controller is further configured to control the first shutter mechanism to block the inlet and the second shutter mechanism to open the outlet when the outlet is butted with the pickup port.

14. The vending machine according to claim 2, wherein a second sensor is arranged in the bucket, wherein the second sensor is configured to detect the height of the commodity to be conveyed entering the bucket, and the second sensor is electrically connected with the controller, wherein the controller is further configured to adjust the height of the first shutter mechanism when the first shutter mechanism blocks the inlet and the height of the second shutter mechanism when the second shutter mechanism blocks the outlet according to the height of the commodity to be conveyed entering the bucket.

15. The vending machine according to claim 3, wherein a second sensor is arranged in the bucket, wherein the second sensor is configured to detect the height of the commodity to be conveyed entering the bucket, and the second sensor is electrically connected with the controller, wherein the controller is further configured to adjust the height of the first shutter mechanism when the first shutter mechanism blocks the inlet and the height of the second shutter mechanism when the second shutter mechanism blocks the outlet according to the height of the commodity to be conveyed entering the bucket.

16. The vending machine according to claim 4, wherein a second sensor is arranged in the bucket, wherein the second sensor is configured to detect the height of the commodity to be conveyed entering the bucket, and the second sensor is electrically connected with the controller, wherein the controller is further configured to adjust the height of the first shutter mechanism when the first shutter mechanism blocks the inlet and the height of the second shutter mechanism when the second shutter mechanism blocks the outlet according to the height of the commodity to be conveyed entering the bucket.

17. The method according to claim 6, wherein the vending machine further comprises a first sensor configured to detect whether the commodity to be conveyed completely enters the bucket, the method further comprising:

judging whether the commodity to be conveyed in the storage column completely enters the bucket according to a signals output by the first sensor; and determining the commodity to be conveyed in the storage column is conveyed into the bucket when it is determined that the commodity to be conveyed completely enters the bucket.

18. The method according to claim 8, further comprising:

controlling the second shutter mechanism to open the outlet when the outlet is butted with the pickup port.

19. The method according to claim 7, wherein the vending machine further comprises a second sensor configured to detect the height of the commodity to be conveyed entering the bucket, the method further comprising:

determining the height of the commodity to be conveyed entering the bucket according to signals output by the second sensor, and adjusting the height of the first shutter mechanism when the first shutter mechanism blocks the inlet and the height of the second shutter mechanism when the second shutter mechanism blocks the outlet according to the height.

20. The method according to claim 8, wherein the vending machine further comprises a second sensor configured to detect the height of the commodity to be conveyed entering the bucket, the method further comprising:

determining the height of the commodity to be conveyed entering the bucket according to signals output by the second sensor, and adjusting the height of the first shutter mechanism when the first shutter mechanism blocks the inlet and the height of the second shutter mechanism when the second shutter mechanism blocks the outlet according to the height.

* * * * *